US006841191B2

(12) United States Patent
Wu

(10) Patent No.: US 6,841,191 B2
(45) Date of Patent: Jan. 11, 2005

(54) VARISTOR AND FABRICATING METHOD OF ZINC PHOSPHATE INSULATION FOR THE SAME

(75) Inventor: Chien-Liang Wu, Kaohsiung Hsien (TW)

(73) Assignee: Thinking Electronic Industrial Co., Ltd., Kaohsiung (TW)

( * ) Notice: Subject to any disclaimer, the term of this patent is extended or adjusted under 35 U.S.C. 154(b) by 231 days.

(21) Appl. No.: 10/071,313

(22) Filed: Feb. 8, 2002

(65) Prior Publication Data

US 2003/0150741 A1 Aug. 14, 2003

(51) Int. Cl.[7] ..... B05D 5/12; H01C 7/112; H01C 17/00

(52) U.S. Cl. ..... 427/79; 427/102; 427/126.3; 427/383.1; 29/610.1; 29/613; 205/50; 205/122; 205/128; 205/143; 205/155

(58) Field of Search ..... 205/50, 122, 128, 205/143, 155; 427/79, 101, 102, 103, 126.3; 29/610.1, 613, 620

(56) References Cited

U.S. PATENT DOCUMENTS

| | | | | | |
|---|---|---|---|---|---|
| 4,140,551 | A | * | 2/1979 | Jones | 148/263 |
| 5,614,074 | A | * | 3/1997 | Ravindranathan | 205/50 |
| 5,757,263 | A | * | 5/1998 | Ravindranathan | 338/21 |
| 6,214,685 | B1 | * | 4/2001 | Clinton et al. | 438/382 |

FOREIGN PATENT DOCUMENTS

| | | | |
|---|---|---|---|
| EP | 806780 | * | 12/1997 |
| JP | 15195 | * | 2/1976 |
| JP | 30911 | * | 1/2000 |

* cited by examiner

*Primary Examiner*—Brian K. Talbot
(74) *Attorney, Agent, or Firm*—William E. Pelton, Esq.

(57) ABSTRACT

A fabricating method and apparatus of an zinc phosphate coating for a varistor has a insulation formed on a surface of a body which does not include two opposite ends of the body formed two outer terminals. The insulation has anti-etch feature for the electrolyte, so that the exposed surface of the body prevents to be etched and to be electroplated a metal material on it. Therefore the varistor has a great fabricating yield and the great shape after electroplating the two outer terminals step.

10 Claims, 5 Drawing Sheets

VARISTOR AND FABRICATING METHOD OF ZINC PHOSPHATE INSULATION FOR THE SAME

BACKGROUND OF THE INVENTION

1. Field of the Invention

The present invention relates to a method of fabricating a varistor with zinc phosphate insulation and the varistor fabricated by the method, and more particularly to a fabricating method that provides flat insulation on outer surfaces of the varistor.

2. Description of Related Art

The prior art discloses a method of fabricating the insulation for a varistor. The varistor has two end terminals and a ceramic body with an outer surface. The method uses a chemical reaction between a phosphoric acid and the surface of the ceramic body to form zinc phosphate insulation on the ceramic body. The zinc phosphate insulation isolates the surface of the ceramic body and the electrolyte, but the zinc phosphate insulation reacts chemically with the ceramic body, so that the body is etched and has a rough surface. A metal material used to coat the end terminals is inadvertently electroplated on the insulation.

Therefore, another method of fabricating the insulation to overcome the problems was developed. The fabricating method uses zinc phosphate deposits on the surface of the ceramic body to keep from etching the surface. Therefore the surface of the body is kept flat, but the insulation layer is still rough. However, metal material is still electroplated on the zinc phosphate and the yield is not good. Therefore this fabricating method does not solve all of the problems.

Therefore, an objective of the present invention is to provide an improved method for fabricating zinc phosphate insulation for a varistor to mitigate and/or obviate the aforementioned problems.

SUMMARY OF THE INVENTION

The main objective of the present invention is to provide a method of fabricating a varistor with zinc phosphate insulation that fabricates a flat surface on the varistor and does not deposit any metal material on the surface and a varistor fabricated by the method.

Other objects, advantages and novel features of the invention will become more apparent from the following detailed description when taken in conjunction with the accompanying drawings.

DETAILED DESCRIPTION OF THE PREFERRED EMBODIMENT

Figure 1A:
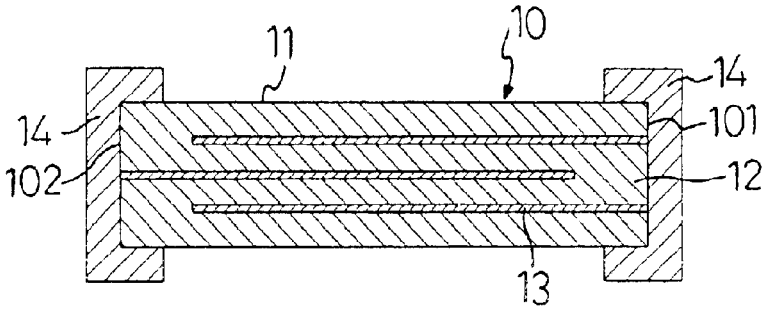
FIGS. 1A to 1D are cross sectional side plan views of the first embodiment of an apparatus in accordance with the present invention.
Figure 1B:
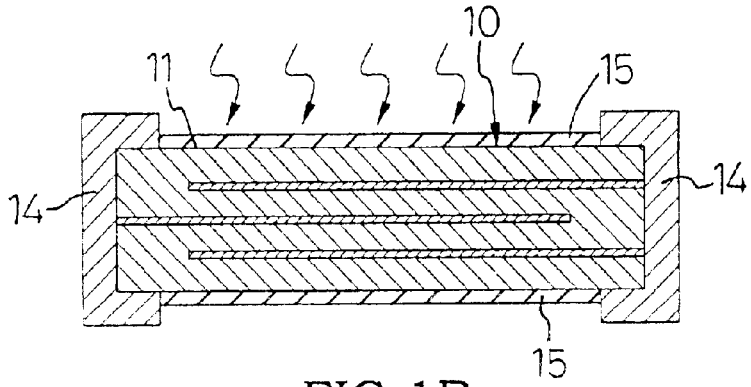
Figure 1C:
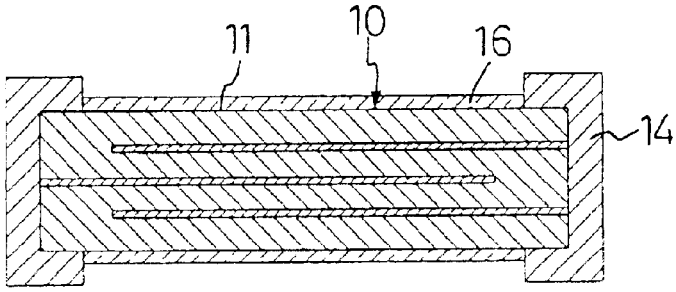
Figure 1D:
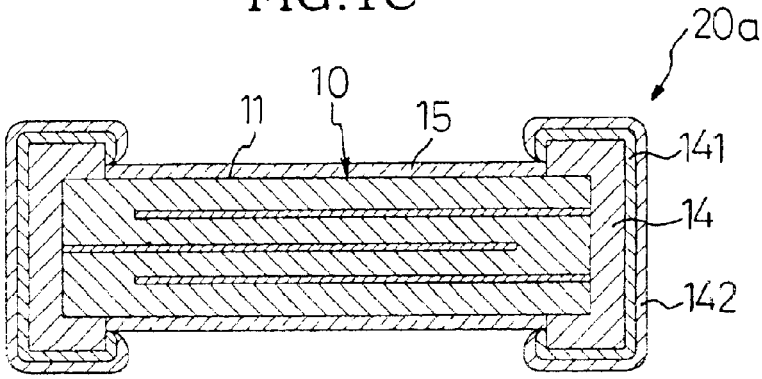

With reference to FIG. 1A, a semi-finished varistor has a body (10) and two outer terminals (14). The body (10) has two opposite ends (101,102), multiple internal electrodes (13) and zinc oxide semiconductor filler (12) covering all of the internal electrodes (13). The two outer terminals (14) are formed on two opposite ends (101,102) of the body (10) and cover the two ends (101, 102) of the body (10). Each outer terminal (14) has an outer face electrically connected to the internal electrodes (13) in the body (10). Each internal electrode (13) is directly connected to only one of the outer terminals (14).

The body further has an exposed surface (11) that is not covered by the outer terminals (14). The zinc oxide semiconductor filler (12) is fabricated using the HTCC process with additives, such as manganese oxide, nickel oxide, cobalt oxide, etc. metal oxide materials. The raw metal oxide materials can be fabricated from an organic salt or inorganic salt, such as carbonate or oxalate. The outer terminals (14) can be made of silver or a metal compound consisting of silver, platinum or palladium. The outer terminals (14) can be fabricated with a printing method, a spraying method, etc. Further, the form of the body (10) can be a rectangle, cylinder, hollow cylinder, etc.

With reference to FIGS. 1A to 1D, a method of fabricating zinc phosphate insulation for a varistor in accordance with the present invention has multiple steps. The method is used to complete the manufacturing process for a varistor (20*a*) and comprises the steps of applying the phosphate compound (15) to the exposed surface (11) of the body (10), heating the phosphate compound (15) until the phosphate compound (15) turns to a transparent insulation (16) and applying metal materials having at least one base layer (141) and at least one solder layer (142) on the outer surface of the outer terminals (14) of the body (10). In the first embodiment of the present invention there is one base layer (141) and one solder layer (142) formed on the outer surface of each outer terminal (14).

When applying the phosphate compound, an over-saturated phosphate liquor is kept at a high temperature to deposit the phosphate compound on the exposed surface. The over-saturated phosphate liquor consists of phosphate ions, zinc ions, inorganic ions and metal ions.

The cured transparent insulation (16) has an anti-etch characteristic when in contact with an electrolyte (not shown) used in an electroplating process, to keep the exposed surface (11) of the body (10) smooth and from being electroplated. The outer terminals (14) are not covered by the insulation (16) so the base layer (141) is applied directly to the terminals (14). The solder layer (142) is subsequently applied to the base layer (141).

The step of applying the base layer (141) and the solder layer (142) to the outer terminals (14) can consist of electroplating, electroless plating, spray plating, rolling plating processes or barrel electroplating. An example of the applying step to form the base layer (141) and the solder layer (142) first uses the barrel electroplating process at 7 amperes for 80 minutes to deposit copper or nickel on an outer face of the outer terminal as the base layer (141). A second electroplating process forms the solder layer (142) on the base layer (141).

The insulation (16) on the exposed surface (11) of the body (10) prevents the exposed surface (11) from being etched by the electrolyte (not shown) and metal material from being deposited on the exposed surface (11) during the electroplating process. Consequently, the body (10) remains flat and smooth and has no metal deposited on the surface (11) of the body (10).

With reference to FIGS. 2A to 2E, a second embodiment of the method in accordance with the present invention further comprises a removing insulation step after the applying the base layer (141) and the solder layer (142) step to expose the surface (11) of the body (10). Therefore, the body (10) of the varistor (20*b*) has a flat surface (11) and two opposite outer terminals (14) with the base layer (141) and the solder layer (142).

Figure 2A:
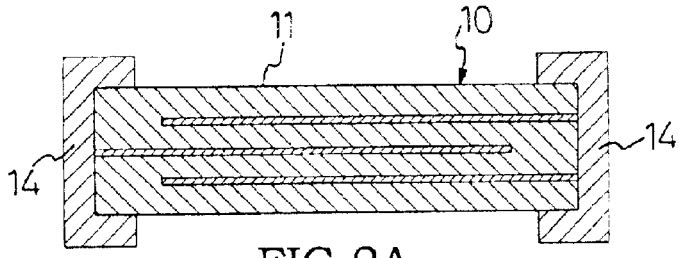
FIGS. 2A to 2E are cross sectional side plan views of the second embodiment of an apparatus in accordance with the present invention.
Figure 2B:
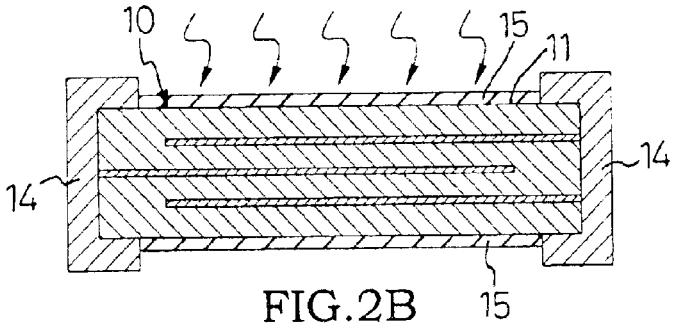
Figure 2C:
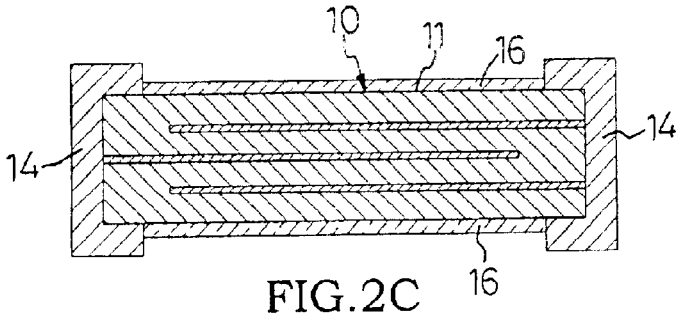
Figure 2D:
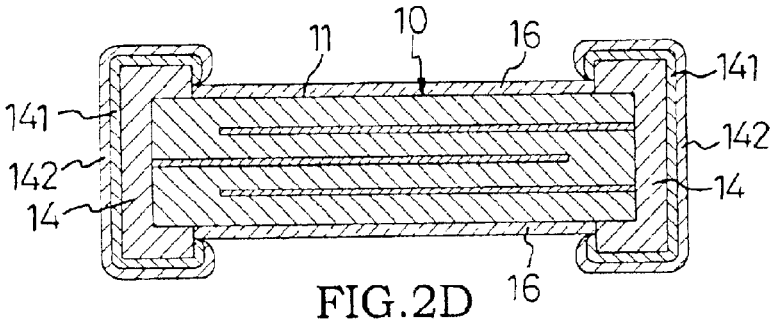
Figure 2E:
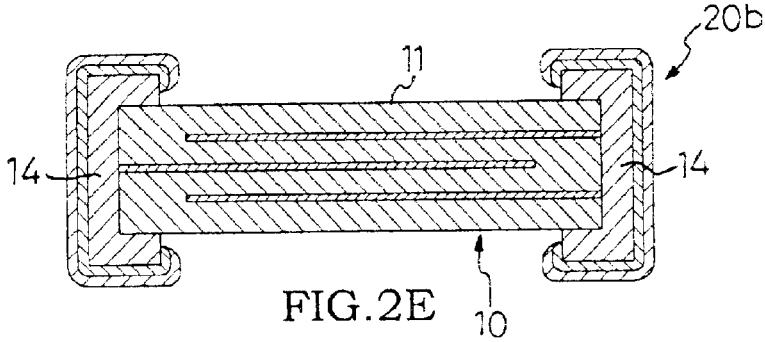
Figure 3A:
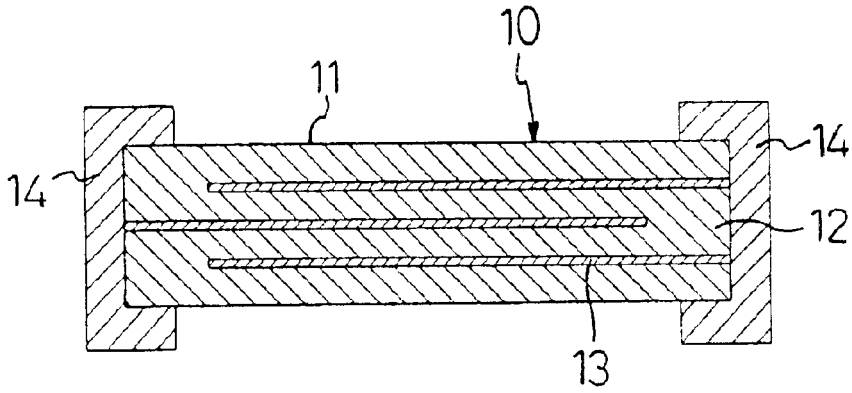
FIGS. 3A to 3F are cross sectional side plan views of the third embodiment of an apparatus in accordance with the present invention.
Figure 3B:
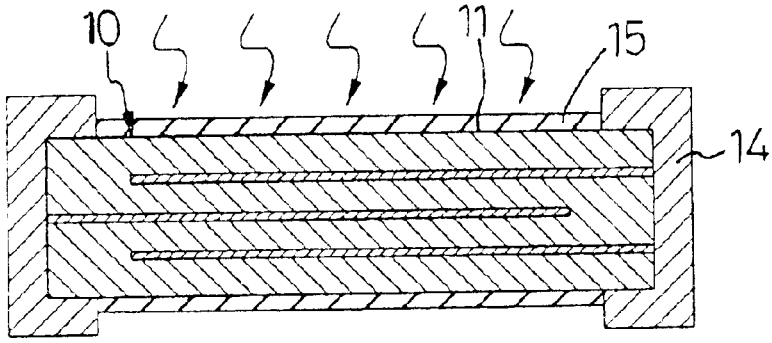
Figure 3C:
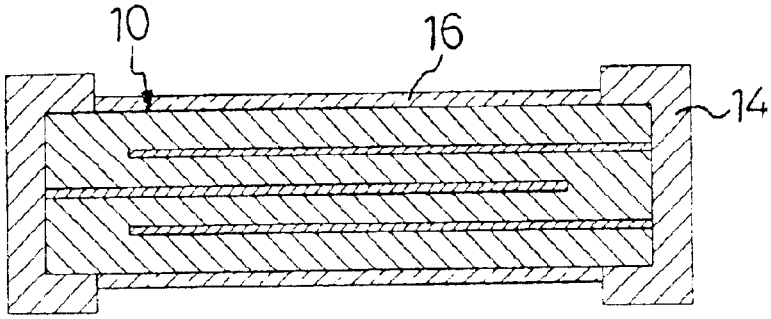
Figure 3D:
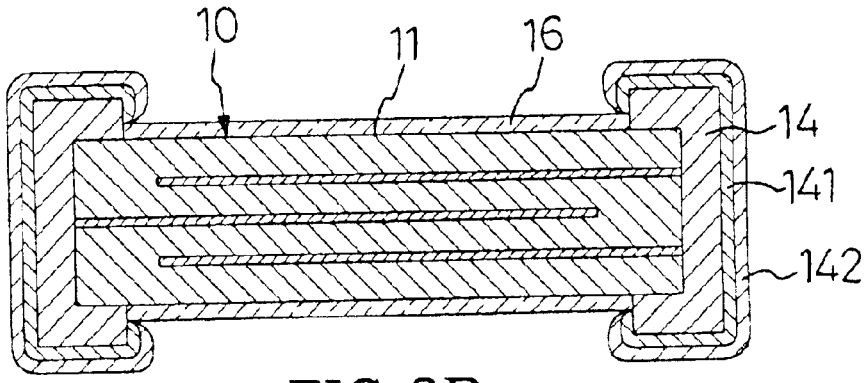
Figure 3E:
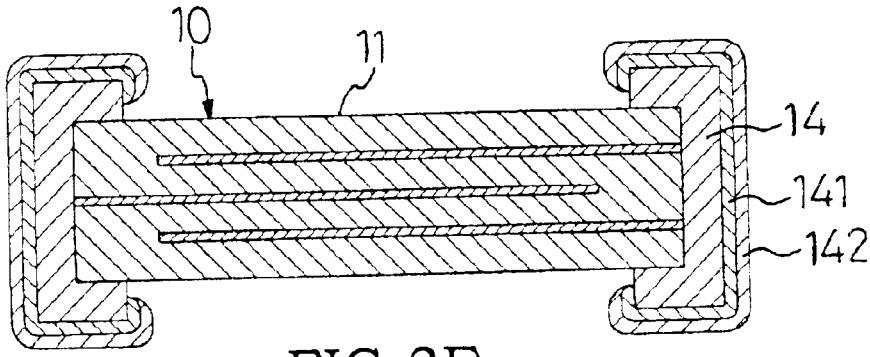
Figure 3F:
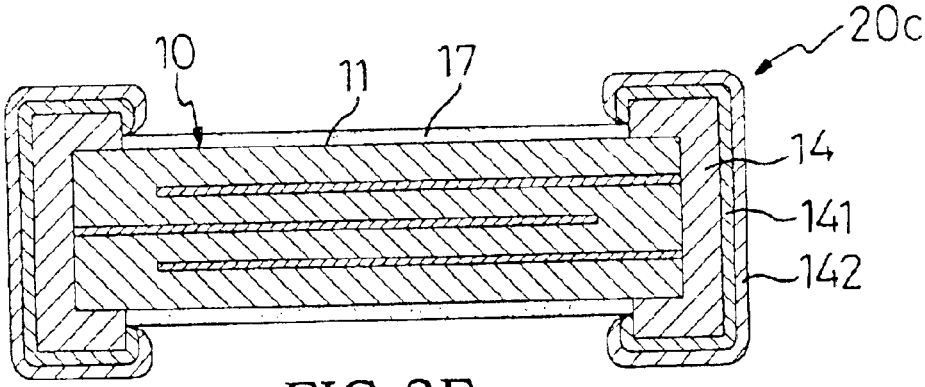
Figure 4A:
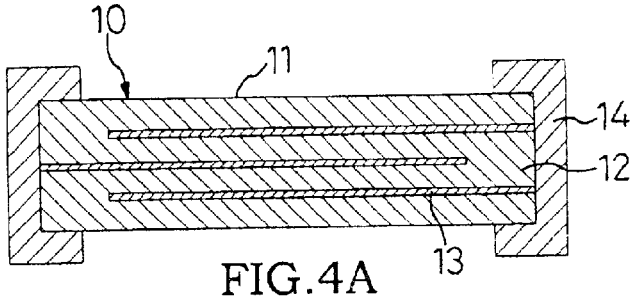
FIGS. 4A to 4E are cross sectional side plan views of the fourth embodiment of an apparatus in accordance with the present invention.
Figure 4B:
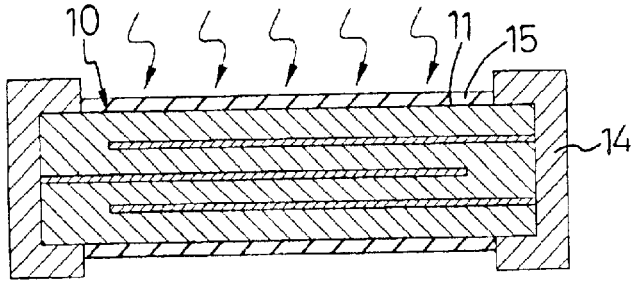
Figure 4C:
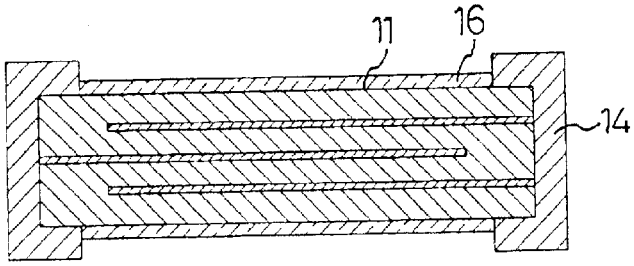
Figure 4D:
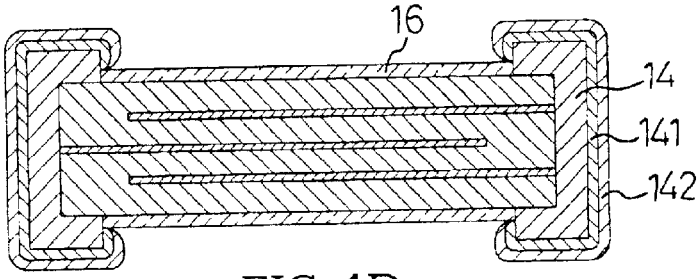
Figure 4E:
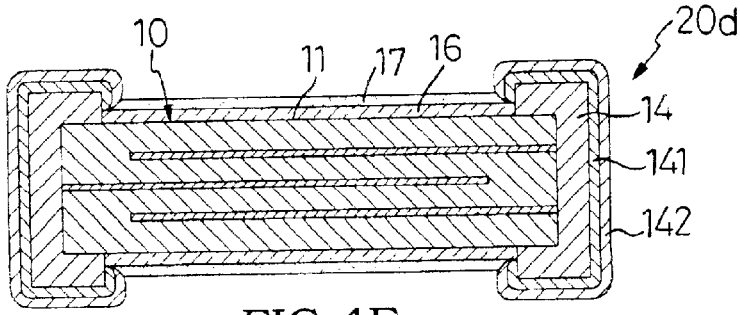

With reference to FIG. 3A to 3F, a third embodiment of the method in accordance with the present invention further comprises an applying protective coating step after removing the insulation layer shown in FIG. 2E. The protective coating (17) can be an organic material, such as acrylic polymer, polyester, epoxy polymer, etc., coating the surface (11) of the body (10). Therefore, the varistor (20*c*) has a body (10), two outer terminals (14) with the base layer (141) and the solder layer (142) and a protective coating (17) formed on the exposed surface (11) of the body (10).

With reference to FIGS. 4A to 4E, a fourth embodiment of the method in, accordance with the present invention performs an applying protective coating step after the step that applies the base layer (141) and the solder layer (142) to the outer terminals (14). Therefore the varistor (20*d*) has a body (10), two outer terminals (14), insulation (16) and a protective coating (17).

As described, the method not only prevents the surface of the varistor from being etched by the electrolyte but also prevents metal material from being electroplated on the exposed surface of the body. Therefore the manufacturing process for varistors has a greater yield and the overall appearance of the completed product is improved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method of fabricating a varistor with zinc phosphate insulation, wherein the varistor has a body with two outer terminals respectively formed on two opposite ends of the body, the fabricating method comprising:

applying and depositing a phosphate compound on a surface of the body, wherein an over-saturated phosphate liquor is kept at a high temperature to deposit the phosphate compound on the surface of the body;

heating the phosphate compound until the phosphate compound turns to a transparent element; and applying metal materials on the two outer terminals of the body, wherein the outer terminals of the body are uncovered by the transparent element so the metal material is formed on the outer terminals directly; wherein the transparent element has an anti-etch feature to keep the surface of the body smooth during the step of applying metal materials.

2. The fabricating method as claimed in claim 1, wherein the method further comprises the step of removing the transparent element after the step of applying metal materials to expose the surface of the body.

3. The fabricating method as claimed in claim 2, wherein the method further comprises the step of applying a protective coating after the step of removing the transparent element to form a protective coating on the surface of the body.

4. The fabricating method as claimed in claim 1, wherein the method further comprises the step of applying a protective coating on the transparent element after the steps of applying the metal materials to protect the surface of the body.

5. The fabricating method as claimed in claim 1, wherein the metal materials comprises at least one base layer and at least one solder layer sequentially formed on each outer terminal.

6. The fabricating method as claimed in claim 1, wherein the over-saturated phosphate liquor consists of phosphate ions, zinc ions, inorganic ions and metal ions.

7. The fabricating method as claimed in claim 1, wherein the step of applying metal materials uses a spray plating process.

8. The fabricating method as claimed in claim 1, wherein the step of applying metal materials uses a rolling plating process.

9. The fabricating method as claimed in claim 1, wherein the step of applying metal materials uses a barrel electroplating process.

10. The fabricating method as claimed in claim 1, wherein the step of applying metal materials uses an electroless plating process.

* * * * *